US006175201B1

(12) United States Patent
Sid

(10) Patent No.: US 6,175,201 B1
(45) Date of Patent: Jan. 16, 2001

(54) ADDRESSABLE LIGHT DIMMER AND ADDRESSING SYSTEM

(75) Inventor: Alberto Sid, New Milford, NJ (US)

(73) Assignee: MAF Technologies Corp., New Milford, NJ (US)

( * ) Notice: Under 35 U.S.C. 154(b), the term of this patent shall be extended for 0 days.

(21) Appl. No.: 09/259,019

(22) Filed: Feb. 26, 1999

(51) Int. Cl.[7] ..... H05B 37/00
(52) U.S. Cl. ..... 315/312; 315/316; 315/292
(58) Field of Search ..... 315/312, 313, 315/318, 316, 317, 319, 292, 293, 294, 295; 362/227

(56) References Cited

U.S. PATENT DOCUMENTS 3,898,643 * 8/1975 Ettlinger ..... 340/324
4,095,139 * 6/1978 Symonds et al. ..... 315/153
4,181,844 * 1/1980 Moretto ..... 307/157
4,392,187 * 7/1983 Bornhorst ..... 362/233
4,947,302 * 8/1990 Callahan ..... 362/233
4,980,806 * 10/1991 Taylor et al. ..... 362/85
5,059,871 * 10/1991 Pearlman et al. ..... 315/316
5,072,216 * 12/1991 Grange ..... 340/825.52
5,245,705 * 9/1993 Swaney ..... 395/200
5,254,908 * 10/1993 Alt et al. ..... 315/312
5,352,957 * 10/1994 Werner ..... 315/291
5,406,176 * 4/1995 Sugden ..... 315/292
5,530,332 * 6/1996 Rees ..... 318/685
5,675,221 * 10/1997 Yoo et al. ..... 315/291
5,831,663 * 11/1998 Waterhouse et al. ..... 348/8
5,920,156 * 7/1999 Carson et al. ..... 315/317
6,020,825 * 2/2000 Chansky et al. ..... 340/825.06

* cited by examiner

*Primary Examiner*—Don Wong
*Assistant Examiner*—Tuyet T. Vo
(74) *Attorney, Agent, or Firm*—Notaro & Michalos P.C.

(57) ABSTRACT

An addressable lighting device and control system uses a DMX protocol controller to selectively generate an electronic address for the addressable lighting device on which the device will respond to all future signals from the controller corresponding to that electronic address. The addressable device has a program mode for setting the address and a working mode for receiving control signals on the set address. The addressable device may have the address set and changed remotely using the DMX protocol controller and a remote control to switch modes, thereby avoiding the problems associated with using DIP switches to set device electronic addresses.

20 Claims, 2 Drawing Sheets

ADDRESSABLE LIGHT DIMMER AND ADDRESSING SYSTEM

FIELD AND BACKGROUND OF THE INVENTION

The present invention relates generally to the field of control systems for lighting devices and in particular to a new and useful electronically addressable device and DMX protocol addressing system for the device.

Theater lighting systems used in stage productions are of ten elaborate and include many different lighting devices and effects devices to produce a desired lighting combination. In recent years, many different aspects of lighting systems have been computerized to improve the ease and speed with which a lighting program for a particular stage show can be set up. While many different control systems are available for this purpose, one protocol which is is generally accepted for use in theater lighting in particular is the DMX protocol. DMX protocol refers to a protocol standard as defined by the United States Institute for Theatre Technology, Inc. (USITT).

Presently, a DMX protocol controller has up to 512 channels transmitted serially to each of any number of connected lighting system devices. Known devices each contain a manually set address circuit which identifies the particular channel or channels that the device will take instructions from the DMX controller. Each of the DMX controller channels has multiple levels, or amplitude settings, to produce different conditions in the connected lighting devices, whether they be dimmers, color mixers, etc. The DMX controller does not produce a digital signal; that is, a binary address cannot be programmed on any one of the DMX controller channels.

A drawback to the known lighting devices used with DMX protocol systems is that the addresses of the devices must be set manually using DIP switches by a person having physical contact with the device. In order to change the address of a particular device, the DIP switches must be reset in the proper configuration for the new address.

When the lighting devices have been mounted on fly rods many feet above a theater stage, this can present a problem. Either the entire fly rod must be lowered to the level of the stage or a stage hand must climb up to the position of the lighting device. When the lighting devices are not mounted on movable theater equipment, but rather in a fixed spot this difficulty is increased. The address switches may be obstructed by other objects as well, including the mounting brackets for the lighting device, further increasing the difficulty of changing the address of a device.

The DMX protocol control system is discussed in connection with the lighting system taught by U.S. Pat. No. 4,947,302. The lighting system is programmable with intensity changes, movements, etc., but the addresses of the lamps and other devices are not programmable.

Other types of lighting systems with digitally addressable devices are known.

For example, a lighting system with programmable addressable dimmers is taught by U.S. Pat. No. 5,530,332, which discusses the problems associated with manually set addressable dimmers and teaches a dimmer which is addressed by first entering a program mode by depressing buttons. An address is then set in the dimmer memory by using a central controller to generate the address location data and send the address to the dimmer. The address location data is a binary word.

U.S. Pat. No. 5,059,871 teaches a lighting system in which individual lamp controllers may have their addresses programmed electronically from a central controller unit. When one of the lamp controllers is placed in a programming mode, a Master Control Unit (MCU) in the central controller unit is used to generate an identification (ID) for the lamp controller. The particular ID is set by incrementing or decrementing any channel on the central controller between 1 and 31. The ID value is shown in binary code on a LED display. The ID in the lamp controller is the address used to select the lamp(s) connected to the lamp controller. The lamp controller may be a dimmer or on/off switch, for example.

A control system with programmable receivers for controlling appliances is disclosed by U.S. Pat. No. 5,352,957. The receivers may control lights, for example. The original addresses for the controlling receivers are initially set manually, but may be changed electronically once the receivers are connected to the control system. The addresses of the receivers are set automatically based on their positioning within the system, rather than by a person on an arbitrary basis.

U.S. Pat. No. 5,245,705 discloses a memory addressing system in which a central control unit sends a message signal with an address code to several attached devices over a bus interface. Devices which are encoded to accept the address code respond to the message signal. At column 6, lines 3–8, this patent indicates that the functional addresses recognized by a device may be changed using a control message. The memory addressing system is not specifically for a lighting system, but rather, is for use in a general data processing system.

Lighting systems using addressable lamps controlled by computers are also known in the prior art.

U.S. Pat. No. 5,406,176 teaches a lighting system controlled by a personal computer. The computer can address individual lamps which have pre-programmed addresses. However, changing the addresses of the lamps using the computer is not taught.

U.S. Pat. No. 4,392,187 discloses a console-controlled lighting system having addressable lights of the manual set type. The electronic address of each light is set using manual thumb switches. The console sends instructions which are interpreted by the light to which they are addressed.

A series of lighting cues can be programmed and stored in memory in each lamp of the lighting system disclosed by U.S. Pat. No. 4,980,806. The different lighting cues, or setups, can be recalled by a signal sent from a central controller. The electronic addresses of the individual lamps are not changed using the controller.

U.S. Pat. No. 5,072,216 discloses a track lighting system having individual lights with manually set address switches contained in the light housings.

None of these prior systems provides a method or system for using a DMX protocol controller to remotely change or set the address of devices connected to the controller.

SUMMARY OF THE INVENTION

It is an object of the present invention to provide an electronically addressable device that can be used with a DMX protocol system and the address of the device can be set remotely using the DMX protocol controller.

It is a further object of the invention to provide a method for using a DMX protocol controller to remotely set the addresses of any number of connected devices.

Accordingly, the invention has a„DMX protocol control, or code generating, system having up to 512 control channels with at least one channel connected to an addressable light dimmer or other device to be controlled. Multiple devices can be controlled by a single DMX protocol controller using the individual channels to send control signals to a specific light dimmer or other device.

Each light dimmer or device being controlled by the DMX protocol controller has an electronic circuit which can interpret DMX control signals. Each light dimmer has an electronic address which is set and is preferably unique to that device. The electronic address setting determines which of the 512 channels of control information the dimmer or device will take instructions from, while ignoring instructions on other channels.

Previously, the electronic address of addressable light dimmers and devices has been set using manual DIP switches on an exterior panel. Thus, once the device is positioned or mounted on a stage set, its address may not be easily changed if access to the device is restricted.

According to the invention, the electronic address for each device can be set electronically using a combination of keypress commands and a control signal from the DMX protocol controller. The keypress commands, which may be made manually on the device or with a remote control, instruct the device to enter an address set, or programming, mode.

Then, all of the DMX channels except for the channel that will address the device are set to zero level. That is, to set the address of the device to 30, DMX protocol controller channel 30 is the only channel not set to zero. The lone non-zero channel level is set to any non-zero level, preferably at least above a threshold level, $V_t$. The DMX protocol controller sends the signals for each channel. The device in address set mode decodes each channel signal and identifies the single non-zero level channel, which it then stores in memory, setting the address of the device to the non-zero level channel. The keypress commands are released and the device returns to normal operation mode.

In a case where the addressable device uses more than one channel, the non-zero level channel sets the base address, and the additional channels used by the device are set as the next sequentially higher channel from the base address channel.

Thus, several of these addressable devices can be positioned or mounted, as on a theater stage and using a combination of remote controls and the DMX controller, the addresses of each may be set easily from a distance without disturbing their positioning.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
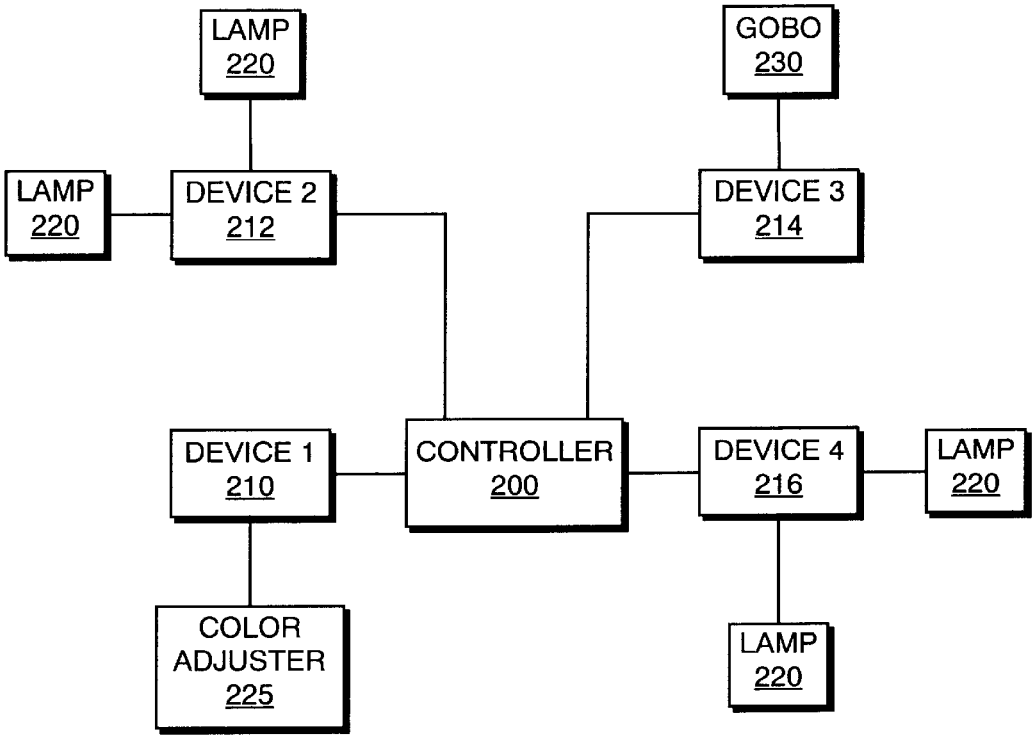
FIG. 1 is a schematic representation of the layout of a control system of the type used in the invention.

Referring now to the drawings, in which like reference numerals are used to refer to the same or similar elements, FIG. 1 shows a schematic depiction of a lighting system using a DMX protocol controller 200 to coordinate and set the values of each of several addressable control devices 210, 212, 214, 216, which convert an information signal from one or more of the DMX controller 200 channels into a usable signal for one or more attached lighting elements such as lamps 220, color adjustors 225 or gobo wheels 230, for example. Thus, the addressable control devices 210–216 could be dimmers or other types of control devices used in theatrical lighting. The addressable control devices 210–216 include circuits for setting the electronic address that determines which channel or base channel in the signal from the DMX controller 200 is received and interpreted by the addressable control devices 210–216.

As discussed above, known DMX controllers have up to 512 channels, each of which can transmit a different amplitude level. The amplitude level on each channel can be set to one of up to 255 discrete levels, with zero as the lower bound. The present invention takes advantage of the fact that the amplitude signal of each channel can be set individually and independently of the other channels combined with the fact that the signal from each channel is always transmitted serially in the same order at a constant rate with constant period in a repeating manner. That is, all 512 channels are continuously broadcast from the controller in series starting with channel 1, like a clock pulse train having different amplitudes.

Figure 2:
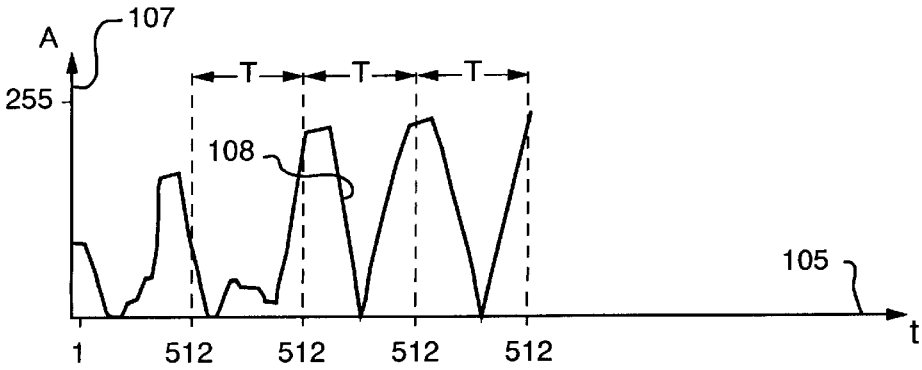
FIG. 2 is a graphical depiction of a signal generated by a DMX protocol controller.

FIG. 2 shows a sample output signal 108 from a DMX protocol controller having 512 channels. Relative time is shown along the x-axis 105 and analog amplitude is shown on the y-axis 107. The time at which the $512^{th}$ channel is broadcast is marked along the time axis 105 to show the repeating nature of the signal 108. As can be seen, a fixed time period T passes between each broadcast of the $512^{th}$ channel. Each of the 512 channels is broadcast sequentially during the time t encompassed by the period T. Depending on the length of period T and changes made at the DMX controller, the signal 108 may repeat several times before changing, or it may change in the next cycle.

Figure 3:
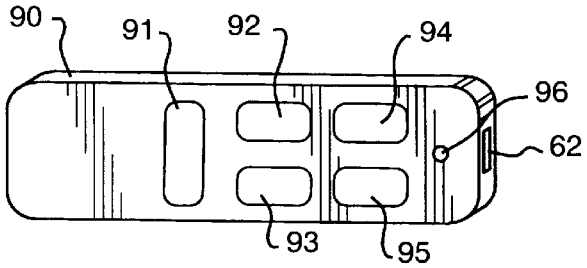
FIG. 3 is a perspective view of a remote control used with the invention.
Figure 4:
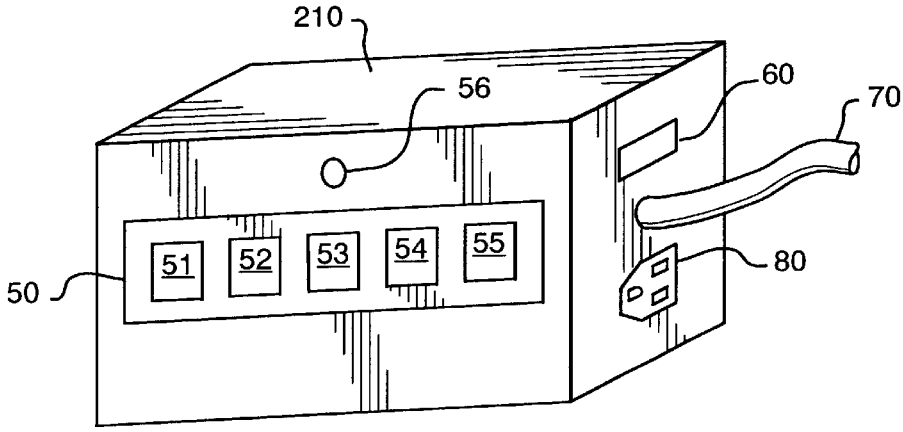
FIG. 4 is a perspective view of one type of addressable control device used with the invention.

FIGS. 3 and 4 illustrate generally an addressable control device 210 and a remote control unit 90 that can be used with the invention.

The addressable control device 210 has a button panel 50 with a series of control buttons 51–55 and an LED indicator 56. The control buttons 51–55 are used to operate the device 210 to manually control a connected element, such as a lamp. For example, the buttons 51–55 may be part of a dimmer control circuit and include level up and level down buttons, preset level buttons and a power switch. For use with the invention, at least one combination of button presses can be used to switch an address circuit inside the device between an operating mode and a programming mode. For example, if both buttons 51 and 52 are held down simultaneously, the control device 210 will switch modes. The LED indicator 56 can be used to indicate when a button has been pressed and when the mode has been changed, such as by blinking repeatedly while in the programming mode.

A power connection 80, control cable 70 and infrared sensor 60 are provided on the control device 210. The control cable 70 is used to receive signals from the DMX controller 200. Power connection So can be used to connect a controlled lighting element. The lighting element can be controlled by varying the power output to the element. Infrared sensor 60 is used to receive signals from the remote control 90.

The remote control 90 includes buttons 91–95 which correspond to the same functions as are found on the control device 210. The remote control 90 can be used to change settings on the control device 210 from a distance, thereby eliminating the need to be in physical proximity to the control device 210 to switch to the programming mode. from the operating mode, for example.

Additional infrared sensors can be provided on the control device 210 80 that at least one sensor is capable of receiving signals from remote control 90 when the addressable control device 210 is positioned above a theater stage for use in a lighting arrangement. Preferably, the LED indicator 56 is visible to provide visual confirmation that signals sent from the remote control 90 are received by the addressable control device 210.

The addressable control device 210 has the address circuit inside which is used to set and change the electronic address of the device. The electronic address of the control device 210 is the channel or base channel of the signal sent by the DMX controller 200 that the control device 210 will take instructions on during operation. The control device 210 may have a base address when multiple channels are used to operate the control device 210. In such a case, the electronic address is set to the lowest number channel that information will be broadcast on. The control device 210 will then take information from the signal broadcast by the DMX controller on the base channel and each sequential channel after the base channel to obtain the full signal needed to operate the control device 210. An example of how the electronic address of the control device 210 can be set is as follows.

All connected control devices 210–216 which will have the same electronic address are switched into the programming mode either using the buttons 51–55 on the control devices 210–216 themselves, or the remote control 90. The DMX controller 200 is set so that all of the channels have amplitude levels of zero, except for the channel which corresponds to the electronic address the control device 210 will be set to.

Figure 5:
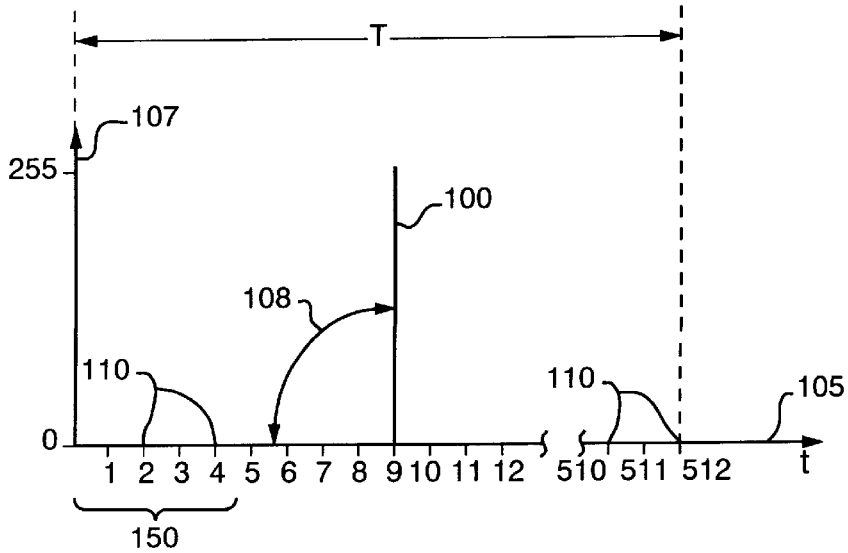
FIG. 5 is a graphical depiction of the output of a DMX protocol controller when setting an address of one of the addressable control devices.

FIG. 5 is an illustration of one possible signal sent by a DMX controller 200 to one or more addressable control devices 210–216 connected to the controller 200 to set the electronic address of whichever devices are in the programming mode. The amplitude level of the signal 108 is shown on the y-axis 107 versus time on the x-axis 103. The graph shows the amplitude level 108 of each channel as the amplitude level of all 512 channels is sent sequentially in time t during period T. All of the channels 150 are set to zero level 110, except for channel 9, which is set to any non-zero amplitude level 100. The control signal 108 is then sent to the connected devices 210–216, which receive the repeating signal of period T and interpret the amplitude level of each channel 150. The electronic address of any control devices 21–216 in the programming mode will be set to the non-zero level channel.

Thus, in this example, the electronic addresses of any connected control devices 210–216 which are in the programming mode will be set to channel 9. If the connected control device 210–216 in programming mode is a multi-channel device, the base address will be set to channel 9, and channels 10, 11, 12, etc. will be used in sequence for the remaining channels by the control device.

Once the DMX control signal 108 has been sent while the control devices 210–216 are in the programming mode, the signal 108 can be terminated and the control devices 210–216 switched back to operating mode. A different electronic address can then be set for other control devices 210–216.

Alternatively, the DMX controller 200 amplitude levels for each channel can be set first, followed by placing the appropriate control devices 210–216 in programming mode. Clearly, the controller signal 108 for setting the electronic address should be terminated or the control devices 210–216 taken out of programming mode before changing settings during programming to avoid errors.

Although the invention is described using a DMX protocol controller to generate the address programming signal, it is possible to use another protocol controller having similar features. As noted above, a feature of the DMX protocol which makes it usable for this purpose is the repeating, periodic nature of the serial output signal, which permits the addressable control devices to determine which channel has a non-zero amplitude level when in the programming mode. Thus, another serial transmitting controller having a plurality of channels could be used if the channel amplitude levels are transmitted sequentially in a periodic repeating pattern.

Further, the invention could be used with other types of control systems other than theater lighting systems. The invention is ideal for any situation where a central controller is used to operate individual control devices where rapid changing of addresses of the control devices is desired. A clear advantage of the invention over the prior art devices is the ease with which the address of each control device connected to the controller can be changed without dismounting or removing the control device from its location.

While a specific embodiment of the invention has been shown and described in detail to illustrate the application of the principles of the invention, it will be understood that the invention may be embodied otherwise without departing from such principles.

What is claimed is:

1. A control system, comprising:

a controller having an output signal composed of a plurality of channels transmitted repeatedly in sequence, in a set period, an amplitude level of each channel being set independently of the other channels;

a plurality of addressable control devices, each addressable control device being connected to the controller and corresponding to at least one of the channels, each addressable control device having a changeable electronic address, switch means for switching between a program mode and an operation mode a plurality of times for remotely changing the address of each addressable control device a plurality gf times, each addressable control device being in its program mode when its address is changed, and receiving means for receiving the output signal of the controller, the electronic address of each addressable control device being set by the output signal when the addressable control device is in the program mode, the amplitude level for one of the channels of the output signal, corresponding to an addressable control device which is in its program mode, having its address being set non-zero, while the amplitude level for the channels corresponding to the other addressable control devices is zero.

2. A control system according to claim 1, further comprising remote control means for operating the switch means between the program mode and operation mode.

3. A control system according to claim 1, further comprising indicating means for indicating when the addressable control device is in the program mode.

4. A control system according to claim 1, wherein the electronic address is a base address corresponding to the lowest channel of at least two channels of the output signal the addressable control device receives data from.

5. A control system according to claim 1, wherein the controller and at least addressable one control device are part of a theater lighting system.

6. A control system according to claim 1, wherein the controller is a DMX protocol controller.

7. A control system according to claim 6, wherein the controller and at least addressable one control device are part of a theater lighting system.

8. A method of programming addresser of addressable control devices in a lighting control system having a controller connected to the addressable control devices, the method comprising:

providing a plurality of addressable control devices, each addressable control device having a programming mode and an operating mode being switchable to the-programming mode a plurality of times for remotely changing an electronic address of each addressable control device a plurality of times, each addressable control device being in its program mode when its address is changed, and means for setting and storing the electronic address for each addressable control device;

placing at least one addressable control device in the programming mode;

providing a controller producing an output signal composed of a plurality of channels, each channel having an amplitude level which is set independently of the other channels, the plurality of channels being transmitted repeatedly in sequence in a fixed period, each addressable control device corresponding to at least one of the channels;

setting all of the channels of the controller to zero amplitude level, except for one channel which is set to any non-zero amplitude level;

transmitting the output signal to the addressable control devices in programming mode, the means for setting and storing the electronic address receiving the output signal and determining which channel of the plurality of channels is a non-zero amplitude level channel and setting the electronic address of the addressable control device to the non-zero amplitude level channel, the channels of the other addressable control devices being at a zero amplitude level.

9. A method according to claim 8, further comprising switching the at least one addressable control device to the operating mode.

10. A method according to claim 8, wherein at least the placing the at least one addressable control device in programming mode is done from a physically remote location from the control device.

11. A method according to claim 8, further comprising mounting the at least one addressable control device in a physically remote location from the controller.

12. A method according to claim 11, wherein the at least one addressable control device is placed in programming mode using a remote control.

13. A method according to claim 8, wherein the controller is a DMX protocol controller.

14. A method according to claim 13, further comprising mounting the at least one addressable control device in a physically remote location from the DMX protocol controller.

15. A method according to claim 14, wherein the placing the at least one addressable control device in programming mode is done using a remote control.

16. An addressable control device for use with a control system that generates an output signal composed of a plurality of channels repeatedly transmitted serially in a fixed period, each channel having an amplitude level which is set independently of the other channels, the addressable control device comprising:

a housing;

signal means for receiving the output signal in the housing;

mode means for switching between a programming mode and an operating mode in the housing a plurality of times and each time an electronic address of the housing is to be changed; and addressing means for electronically setting and storing an electronic address corresponding to one of the plurality of channels in the output signal received by the signal means, the electronic address being set in the programming mode to the one of the plurality of channels received in the output signal that has a non-zero amplitude level while all other channels have a zero amplitude level.

17. A device according to claim 16, further comprising a remote control for activating the mode means from a physically remote location from the housing.

18. A device according to claim 16, further comprising sensor means for receiving remotely transmitted signals for operating the mode means.

19. A device according to claim 16, wherein the mode means comprises at least one button on the housing and a circuit means for switching between modes when the at least one button is depressed.

20. A device according to claim 19, further comprising a remote control for activating the circuit means from a physically remote location from the housing.

* * * * *

UNITED STATES PATENT AND TRADEMARK OFFICE

CERTIFICATE OF CORRECTION

PATENT NO. : 6,175,201 B1
DATED : January 16, 2001
INVENTOR(S) : Alberto Sid

It is certified that error appears in the above-identified patent and that said Letters Patent is hereby corrected as shown below:

Column 6,
Line 56, change "gf" to -- of -- .

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*